United States Patent [19]

Kopnicky

[11] 4,450,736

[45] May 29, 1984

[54] IMPACT-ACTUATED GRIPPING TOOL

[75] Inventor: Robert J. Kopnicky, Valparaiso, Ind.

[73] Assignee: Bethlehem Steel Corp., Bethlehem, Pa.

[21] Appl. No.: 376,874

[22] Filed: May 10, 1982

[51] Int. Cl.[3] ..... B25B 19/00

[52] U.S. Cl. ..... 81/463; 81/64

[58] Field of Search ..... 81/463, 64, 91 R, 3.38 R; 294/20, 19 A

[56] References Cited

U.S. PATENT DOCUMENTS

| | | | |
|---|---|---|---|
| 1,365,857 | 1/1921 | Seder . | |
| 1,525,894 | 2/1925 | Seppmann . | |
| 1,686,250 | 10/1928 | Page | 294/86 CG |
| 2,016,078 | 10/1935 | Henaere | 294/20 |
| 2,268,598 | 1/1942 | Kellems | 294/86 CG |
| 3,222,915 | 12/1965 | Swisher | 72/457 |
| 3,232,658 | 2/1966 | Clapp | 294/20 |
| 3,280,455 | 10/1966 | Smith | 29/254 |
| 3,529,497 | 9/1970 | Brooks | 81/52.35 |
| 3,750,500 | 8/1973 | Peterson | 81/52.35 |

*Primary Examiner*—James L. Jones

*Attorney, Agent, or Firm*—John I. Iverson; John J. Selko

[57] ABSTRACT

An impact-actuated tool for gripping and unscrewing an atomizing air tube which is screwed into the internal structure of a burner assembly. The tool includes an elongated bar member having slidable hammer means thereon and a gripping head mounted on one end thereof, said gripping head being radially expandable and torsionally deformable.

2 Claims, 3 Drawing Figures

FIG. 2
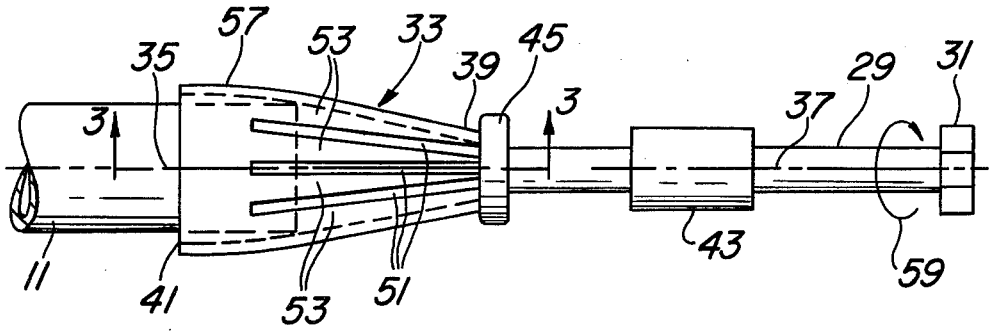
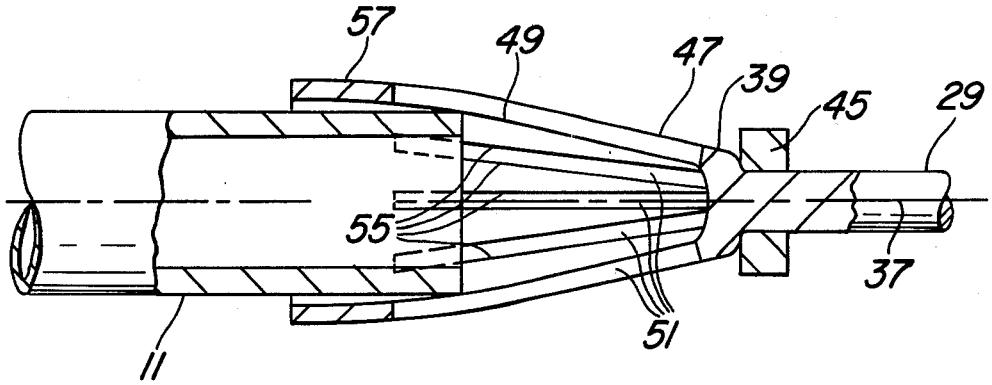
FIG. 3

IMPACT-ACTUATED GRIPPING TOOL

BACKGROUND OF THE INVENTION

Certain types of burner assemblies used in industrial furnaces have an atomizing air tube, one end of which is screwed into the internal structure of the burner assembly. The other end of the atomizing air tube is recessed below the surface of the burner nozzle, and therefore not readily accessible for gripping and unscrewing by a conventional tool. Therefore, removal of the atomizing air tube has required disassembly of the parts of the burner assembly which are externally mounted on the furnace.

SUMMARY OF THE INVENTION

There is therefore provided in this invention an impact-actuated tool for insertion into the nozzle of a burner assembly for gripping and unscrewing an atomizing air tube, for removal thereof, without disassembling the burner assembly. The tool of this invention includes an elongated bar member with a hollow gripping head at one end. The gripping head includes a first sidewall portion which has a plurality of longitudinally extending slots therein. The slots provide a plurality of separate, individual, radially expandable and torsionally deformable segments in said first side wall portion, which segments include a plurality of corners, or edges, to effect gripping of the atomizing air tube. Hammer means, slidably mounted on the elongated bar member impacts against the gripping head to cause the gripping head to grip the atomizing air tube for unscrewing.

BRIEF DESCRIPTION OF THE DRAWINGS

FIG. 2 is a plan view of the tool of this invention gripping an atomizing air tube to be unscrewed.

FIG. 3 is a cross-sectional view along the line A—A of FIG. 2.

DESCRIPTION OF PREFERRED EMBODIMENT

Figure 1:
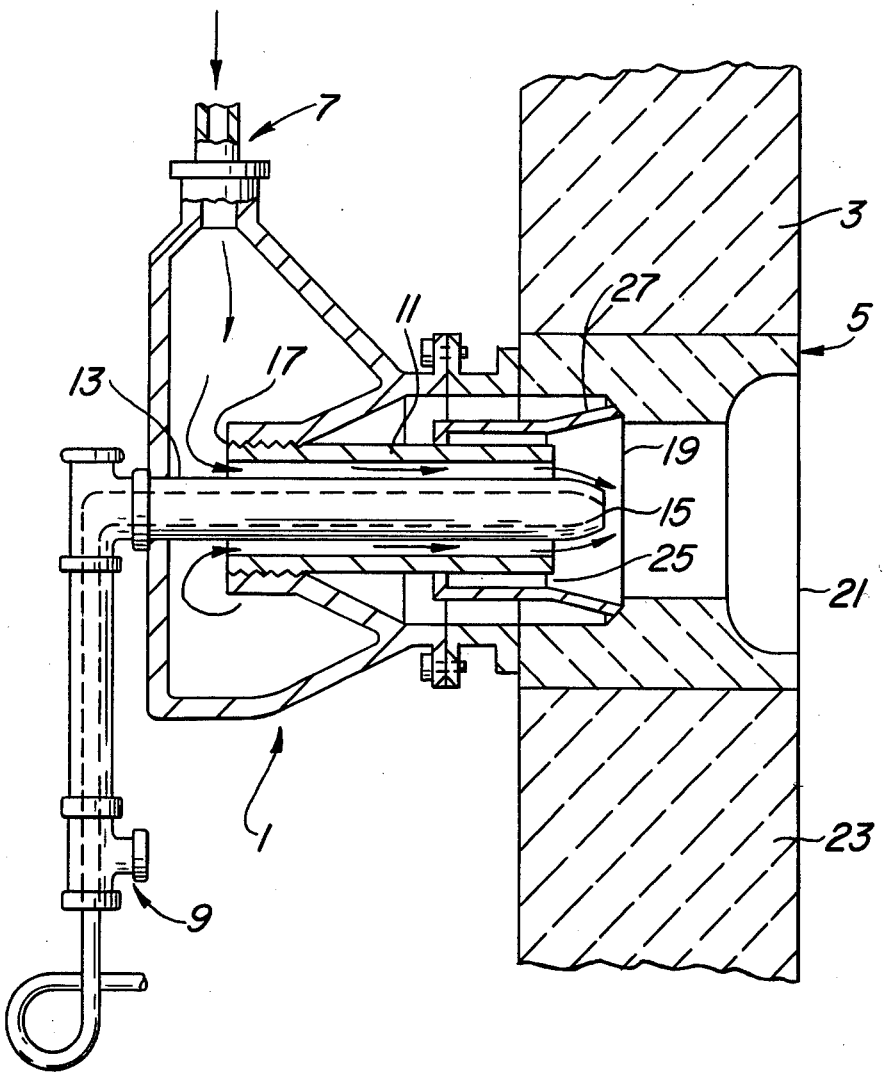
FIG. 1 is an elevational view, partly in section, showing a portion of a furnace wall with a burner assembly mounted thereon.

FIG. 1 shows burner assembly 1 mounted on wall 3 of furnace 5. Burner assembly 1 includes conventional atomizing air supply means 7 and conventional oil supply means 9. Atomizing air enters oil burner assembly 1 and proceeds through atomizing air tube 11. Oil enters burner tube 13 and mixes with atomizing air at burner tip 15 to form a combustible fuel. Atomizing air tube 11 is fastened to oil burner assembly 1 by threaded end 17, as is well known.

Atomizing air tube 11, the workpiece to be unscrewed, is recessed below the surface of burner nozzle 19, which in turn is recessed below the inner surface 21 of burner tile 23 in wall 3 of furnace 5. Access to one end of atomizing air tube 11 is possible through aperture 25 in burner nozzle 19. There is a limited clearance, or space, between the outer surface of atomizing air tube 11 and wall 27 of burner nozzle 19.

It should be understood that the details of burner assembly 1 are conventional and well known, and form no part of the invention described herein. Such details are set forth in order to describe the environment and structure in which the tool of this invention is used. From time to time, it becomes necessary to remove, by unscrewing, the workpiece, atomizing air tube 11. Heretofore, such removal has been effected by disassembly of burner assembly 1, which is external of the furnace wall 3 and readily accessible. Removal of atomizing air tube 11 from inside the furnace via aperture 25 has not been possible, because there has not been a tool suitable for engaging and unscrewing atomizing air tube 11 via aperture 25 in burner nozzle 19.

Referring to FIG. 2, the tool of this invention is shown. The tool comprises an elongated bar member 29 having a stop means 31, such as a large nut, at one end. A holow, tubular, frustoconical gripping head 33 is concentrically fastened to the other end of bar member 29, such that the longitudinal axis 35 of gripping head 33 is substantially coincident with the longitudinal axis 37 of bar member 29. Gripping head 33 is fastened, as by welding or otherwise, at its proximal end 39 to bar member 29, and has a distal end 41 forming an opening for receiving, or fitting over, atomizing air tube 11 to be unscrewed.

Hammer means 43 is slidably mounted on bar member 29 for movement between stop means 31 and gripping head 33. A second stop means 45 for receiving impacts from said hammer means 43 is optional.

As is shown in FIG. 3, gripping head 33 further includes a first sidewall portion 47 adjacent proximal end 39, said first sidewall portion 47 having an inner surface 49 which converges slightly inwardly in the direction of elongated member 29. Although the outer surface of first sidewall portion 47 is also shown converging inwardly, such outer surface can also be non-converging.

First sidewall portion 47 is radially expandable and torsionally deformable. Radial expansion and torsional deformation is provided in first sidewall portion 47 by means of a plurality of slots 51, which extend longitudinally along said first sidewall portion 47 and which slots 51 extend through the thickness of said first sidewall portion 47. Thus, it can be understood that first sidewall portion 47 of gripping head 33 is comprised of a plurality of separate, individual segments 53, each segment 53 being capable of limited radial expansion and torsional deformation. Slots 51 provide segments 53 with a plurality of edges, or corners 55, which tend to grip atomizing air tube 11.

Radial expansion refers to elastic movement of first sidewall portion 47 in directions generally away from longitudinal axis 35 of gripping head 33. Torsional deformation refers to elastic deformation of first sidewall portion 47 in directions generally concentric with longitudinal axis 35 of gripping head 33.

Also shown in FIG. 2 and FIG. 3, second sidewall portion 57 adjacent distal end 41 of gripping head 33 is rigid, that is, essentially non-expandable radially or torsionally, because second sidewall portion 57 is continuous, with an absence of slots as are found in first sidewall portion 47.

OPERATION OF INVENTION

To operate the tool, the operator enters the furnace, when conditions are suitable, and inserts distal end 41 through aperture 25 in burner nozzle 19 and over the end of atomizing air tube 11 to be unscrewed. Hammer means 43 is reciprocated along elongated bar member 29 to impact against proximal end 39 of gripping head 33 to cause gripping head 33 to engage, by force fitting, the inner surface 49 of first sidewall portion 47 against the end of atomizing air tube 11 in a locking relation. Repeated impact of hammer means 43 forces gripping head 33 onto atomizing air tube 11 in a locking relation, as a result of radial expansion of individual segments of first sidewall portion 47.

After gripping head 33 is engaged with atomizing air tube 11, stop means 31 is engaged by conventional gripping means, such as a wrench, and atomizing air tube 11 is unscrewed by the application of twisting or torsional force, as shown by arrow 59 of FIG. 2. The application of such twisting force causes the individual segments 53 of first sidewall portion 47 to deform slightly in a torsional manner, to further enhance the locking relationship between gripping head 33 and atomizing air tube 11.

Upon removal of atomizing air tube 11, as hereinbefore described, gripping head 33 is disengaged from atomizing air tube 11 by the operator grasping such atomizing air tube 11 and reciprocating hammer means 43 to impact against stop means 31.

Hollow gripping head 33 is shown to be tubular, having a cross section essentially circular in the distal end, because atomizing air tube 11 is essentially circular in cross section.

I prefer to have gripping head 33 to have a wall thickness of 0.1875 inches, with at least 8 slots therein, although a different number of slots 51 and different wall thickness can be utilized, so long as there are provided radially expandable and torsionally deformable segments 53.

I claim:

1. An impact-actuated gripping tool comprising:

(a) an elongated bar member having a bolt means at one end;

(b) a hollow, frustoconical gripping head having a proximal end fastened to the other end of said bar member and a distal end forming an opening for receiving a work piece to be unscrewed;

(c) hammer means slidably mounted on said bar member for movement between said bolt means and said gripping head;

(d) said gripping head further comprising:

(i) a first sidewall portion adjacent said proximal end, said first sidewall portion having an inner surface converging inwardly in the direction of said elongated bar member, said first sidewall portion including a plurality of longitudinally extending slots through the thickness of said first sidewall portion, dividing said first sidewall portion into a plurality of separate, individual segments, each of said segments being radially expandable and torsionally deformable, and (ii) a second sidewall portion adjacent said distal end, said second sidewall portion being rigid.

2. The invention of claim 1 in which said segments include a plurality of edges for gripping said workpiece when said tool is twisted to unscrew said workpiece.

* * * * *